US007068219B2

(12) United States Patent
Martin et al.

(10) Patent No.: US 7,068,219 B2
(45) Date of Patent: Jun. 27, 2006

(54) COMMUNICATIONS SYSTEM INCLUDING PHASED ARRAY ANTENNA PROVIDING NULLING AND RELATED METHODS

(75) Inventors: Gayle Patrick Martin, Merritt Island, FL (US); Harry Richard Phelan, Palm Bay, FL (US); Mark Larry Goldstein, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 156 days.

(21) Appl. No.: 10/864,922

(22) Filed: Jun. 10, 2004

(65) Prior Publication Data

US 2005/0285785 A1 Dec. 29, 2005

(51) Int. Cl.
*H01Q 3/24* (2006.01)

(52) U.S. Cl. ..... 342/372

(58) Field of Classification Search ..... 342/154, 342/157, 368, 372, 373
See application file for complete search history.

(56) References Cited

U.S. PATENT DOCUMENTS 4,255,791 A 3/1981 Martin ..... 364/514
4,849,763 A * 7/1989 DuFort ..... 342/372
5,283,587 A * 2/1994 Hirshfield et al. ..... 342/372
5,353,031 A * 10/1994 Rathi ..... 342/372
5,515,060 A 5/1996 Hussain et al. ..... 342/376
5,592,178 A * 1/1997 Chang et al. ..... 342/372
6,188,915 B1 2/2001 Martin et al. ..... 455/562
6,397,083 B1 5/2002 Martin et al. ..... 455/562
6,496,158 B1 * 12/2002 Ksienski et al. ..... 343/853
2003/0224751 A1 * 12/2003 Vanderhelm et al. ..... 455/296
2004/0087294 A1 * 5/2004 Wang ..... 455/276.1

* cited by examiner

*Primary Examiner*—Dao Phan
(74) *Attorney, Agent, or Firm*—Allen, Dyer, Doppelt, Milbrath & Gilchrist, P.A.

(57) ABSTRACT

A phased array antenna may include a plurality of antenna elements, at least one respective phase shifter connected to each antenna element, and at least one respective gain element connected to each antenna element. The phased array antenna may further include at least one controller for determining and controlling both phases and gains of the phase shifters and gain elements, respectively, to provide beamsteering in a first direction for a signal of interest. The controller may also iteratively determine and control phases of the phase shifters to provide a null in a second direction for a signal not of interest, and without determining or controlling gains of the gain elements.

40 Claims, 10 Drawing Sheets

COMMUNICATIONS SYSTEM INCLUDING PHASED ARRAY ANTENNA PROVIDING NULLING AND RELATED METHODS

FIELD OF THE INVENTION

The present invention relates to the field of antenna systems, and, more particularly, to phased array antennas and related methods.

BACKGROUND OF THE INVENTION

Antenna systems are widely used in both ground based applications (e.g., cellular antennas) and airborne applications (e.g., airplane or satellite antennas). For example, so-called "smart" antenna systems, such as adaptive or phased array antennas, combine the outputs of multiple antenna elements with signal processing capabilities to transmit and/or receive communications signals (e.g., microwave signals, RF signals, etc.). As a result, such antenna systems can vary the transmission and/or reception pattern of the communications signals.

For example, each antenna element typically has a respective phase shifter and/or gain element associated therewith. The phase shifters/gain elements may be controlled by a central controller, for example, to adjust respective phases/gains of the antenna elements across the array. Thus, it is not only possible to steer the antenna beam, but it is also possible to perform beam shaping and/or adjust beam width (i.e., "spoiling") to receive or transmit over different areas.

Another advantage of phased array antennas is that the array of elements may be arranged in sub-groups, and each of the sub-groups used for different antenna beams to thus provide multi-beam operation. However, one potential drawback of such multiple beam arrays is that "friendly" signals arriving on one of the beams can be interfered with (i.e., jammed) even by friendly signals arriving on another beam.

The problem of interference may be particularly acute in communications systems, such as cellular telephone systems. That is, cellular base stations constantly send and receive different signals to and from multiple users located at different distances and in different directions. One particularly advantageous approach for mitigating interference at base stations in cellular systems is described in. U.S. Pat. Nos. 6,188,915 and 6,397,083 to Martin et al., both of which are assigned to the present Assignee and are hereby incorporated herein in their entireties by reference.

In particular, the Martin et al. patents disclose a control method for setting weighting coefficients of a phased array antenna at a cellular base station. The weighting coefficients are iteratively refined to desired values by a "bootstrapped" process that starts with a coarse set of amplitude and phase weighting coefficients to which received signals are subjected to produce a first set of signal estimates. These estimates and the received signals are iteratively processed to refine the weighting coefficients so that the gain and/or nulls of the antenna's directivity pattern will enhance the signal-to-noise ratio. Such improved functionality is particularly useful in association with the phased array antenna of a base station of a time division multiple access (TDMA) cellular communication system, for example, where it may be desired to cancel interference from co-channel users located in cells adjacent to the cell containing a desired user and the base station.

Reducing the effects of interference or noise resulting from signals not of interest (SNOIs) may be important in other phased array antenna applications as well. For example, U.S. Pat. No. 5,515,060 to Hussain et al. discloses a clutter suppression approach for a phased array antenna with phase-only nulling for use in a radar system. The phased array antenna includes elemental antennas, each having a transmit/receive (T/R) module associated therewith, distributed over a thinned, circular aperture. A phase controller controls the phase shift imparted by each module to form a main beam and associated sidelobes. A perturbation phase generator portion of a phase controller adds a perturbation phase shift that is selected, in conjunction with a particular thinning distribution, to form a relatively wide null in the sidelobe structure in which signal transduction is reduced. The null is placed on a source of ground clutter or a jammer, for example.

Despite the advantages provided by such systems, further SNOI reduction features may be desirable in certain phased array antenna applications.

SUMMARY OF THE INVENTION

In view of the foregoing background, it is therefore an object of the present invention to provide a phased array antenna which provides nulling to reduce interference from signals not of interest and related methods.

This and other objects, features, and advantages in accordance with the present invention are provided by a phased array antenna which may include a plurality of antenna elements, at least one respective phase shifter connected to each antenna element, and at least one respective gain element connected to each antenna element. Moreover, the phased array antenna may further include at least one controller for determining and controlling both phases and gains of the phase shifters and gain elements, respectively, to provide beamsteering in a first direction for a signal of interest. The at least one controller may also iteratively determine and control phases of the phase shifters to provide a null in a second direction for a signal not of interest, and without determining or controlling gains of the gain elements. That is, the phased array antenna advantageously provides nulling of the signal not of interest using only iterative phase adjustments.

More particularly, each phase shifter may have a plurality of digitally selectable phase settings. As such, the at least one controller may determine the phases to provide the null in the second direction by determining desired phase weights and mapping the desired phase weights to nearest available digital phase settings of the phase shifters. For example, the desired phase weights may comprise an eigenvector, and the at least one controller may limit a step in vector space of the eigenvector to a step limit between successive iterations. Moreover, the controller may iteratively determine and control the phases until the null reaches a threshold.

The controller may determine the desired phase weights based upon a signal covariance and an interference covariance of the antenna elements, for example. Furthermore, the controller may determine the phases and gains of the phase shifters and gain elements to provide beamsteering in the first direction based upon a conjugate beam in the first direction. The antenna elements may also advantageously be arranged in sub-groups to provide multi-beam operation.

A method aspect of the invention is for controlling a phased array antenna such as the one described briefly above. The method may include determining and controlling both phases and gains of the phase shifters and gain elements, respectively, to provide beamsteering in a first direction for a signal of interest. The method may further include iteratively determining and controlling phases of the phase shifters to provide a null in a second direction for a signal not of interest, and without determining or controlling gains of the gain elements, until the null reaches a threshold.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternate embodiments.

Figure 1:
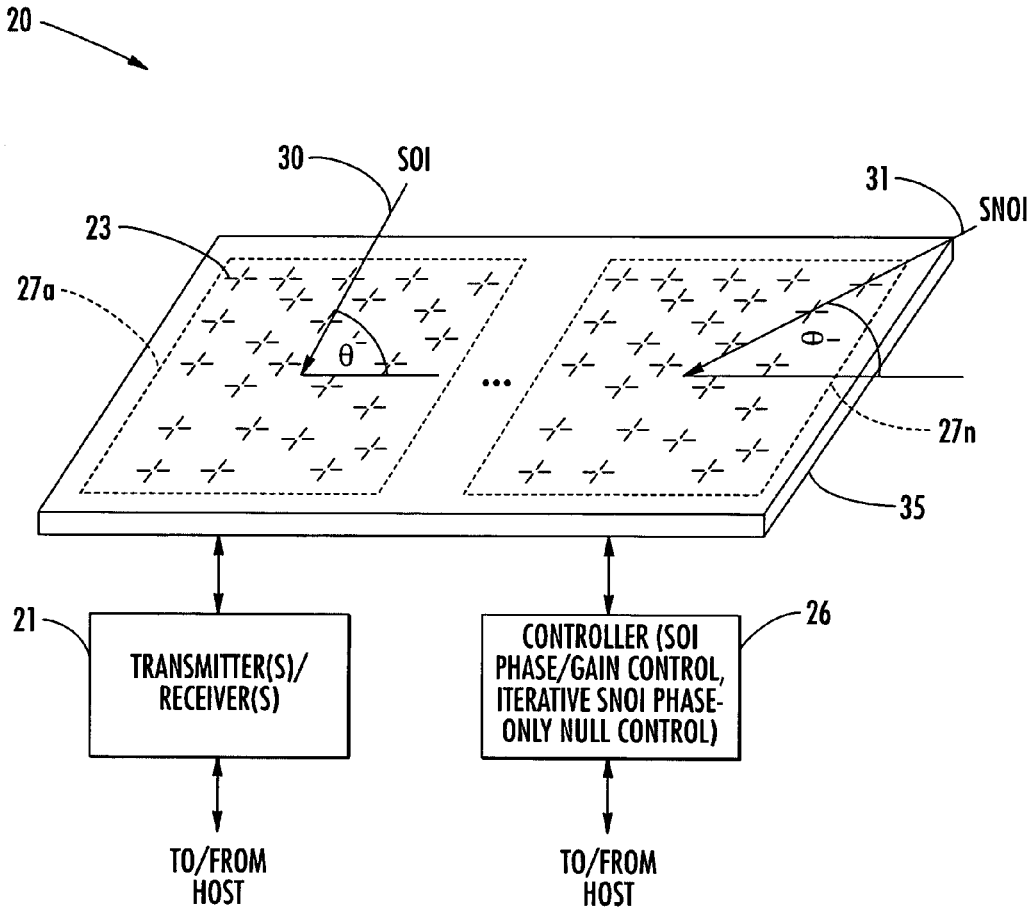
FIG. 1 is schematic block diagram of a communications system in accordance with the present invention.
Figure 2:
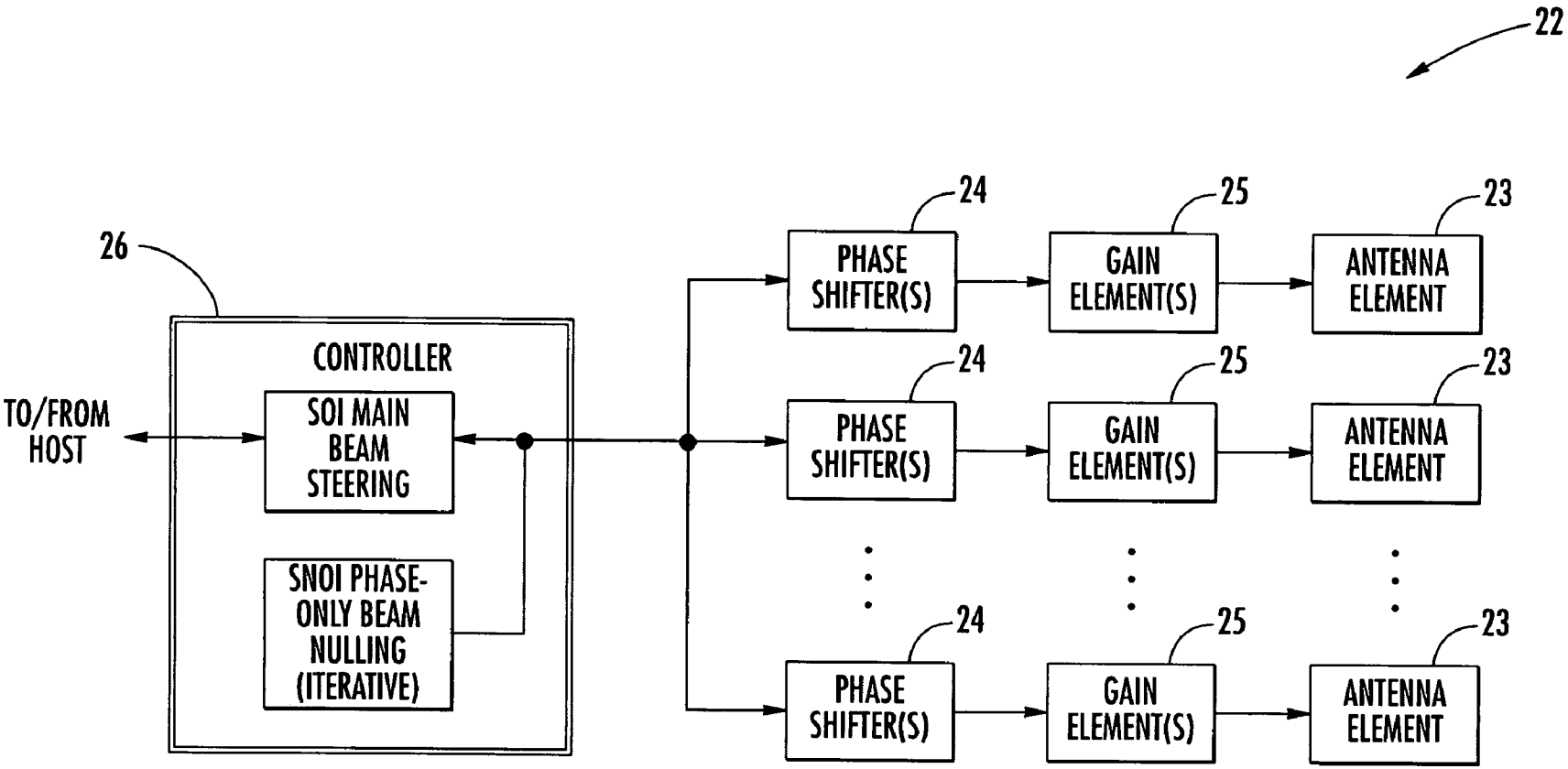
FIG. 2 is schematic block diagram illustrating the phased array antenna of the communications system of FIG. 1 in greater detail.

Referring initially to FIGS. 1 and 2, a communications system 20 in accordance with the present invention illustratively includes one or more communications signal devices 21, such as a communications transmitter and/or receiver, and a phased array antenna 22. The communications signal device 21 conveys communications signals between the phased array antenna 21 and a host, as will be understood by those skilled in the art.

More particularly, the phased array antenna 22 illustratively includes a plurality of antenna elements 23 carried by a substrate 35, one or more respective phase shifters 24 connected to each antenna element, and one or more respective gain elements 25 also connected to each antenna element. By way of example, the phase shifters 24 may be digital phase shifters each having a plurality of digitally selectable phase settings. Moreover, one or more controllers 26 is also included for interfacing with the host and respectively controlling the phases and gains of the phase shifters 24 and gain elements 25 to provide desired beamsteering and/or beam shaping/spoiling, as will be appreciated by those skilled in the art.

While only a single controller 26 is shown, in some embodiments the various functions of the controller may be arranged in a hierarchical fashion. For example, a central controller may provide an interface to the host and provide general phase/gain information to a plurality of sub-array controllers for different sub-arrays or sub-groups 27*a*–27*n* of antenna elements 23. Further, individual element controllers may also be included for respective antenna elements in certain embodiments as well, as will be appreciated by those skilled in the art. Of course, the antenna elements 23 may be arranged in numerous geometries known to those skilled in the art. By way of example, the antenna elements 23 may be arranged in an aperiodic grid in a printed circuit implementation, although other configurations may also be used.

More particularly, the sub-groups 27*a*–27*n* may in some embodiments be used to individually transmit and/or receive different communications signals. That is, the different sub-groups 27*a*–27*n* of antenna elements may be connected to different transmitters and/or receivers to allow communications over different frequencies or channels, as will be appreciated by those skilled in the art.

However, as noted above, such multi-mode operation may in some circumstances result in interference between the various signals being received by the phased array antenna 22. For example, in the illustrated embodiment a signal of interest (SOI) 30 is received by the sub-group 27*a* of antenna elements 23 from a first direction which illustratively corresponds to a scan angle $\theta$. Yet, at the same time a signal not of interest (SNOI) 31 with respect to the sub-group 27*a* is being received by the adjacent sub-group 27*n* from a second direction illustratively corresponding to a scan angle $\Phi$. This may have the undesirable effect of creating a sidelobe in the signal pattern received by the sub-group 27*a* at the scan angle $\Phi$.

The phased array antenna 22 may advantageously use iterative phase-only nulling to mitigate the interference or noise created by the sidelobe at the scan angle $\Phi$. Generally speaking, the controller 26 first determines and controls both phases and gains of the phase shifters 24 and gain elements 25 to provide beamsteering with respect to the sub-group 27*a* in the first direction (i.e., the scan angle $\theta$) for the SOI 30. This may be done by generating initial settings for the phase shifters 24 and gain elements 25 based upon a conjugate beam in the first direction of the SOI 30, as will be appreciated by those skilled in the art.

The controller 26 also iteratively determines and controls phases of the phase shifters 24 to provide a null in the second direction (i.e., the scan angle $\Phi$) for the SNOI, and without determining or controlling gains of the gain elements 25, until the null reaches a threshold. By way of example, a suitable threshold may be −30 dB or less, although other thresholds may also be used. That is, the phased array antenna may advantageously provide nulling of the SNOI 31 using only iterative phase adjustments. As such, nulls may be generated to reduce interference from SNOIs at lower costs than certain prior systems which implement complex weighting configurations at each antenna element or sets of elements.

It should be noted that while the phased array antenna 22 is shown as part of the communications system 20 in the present example, the phased array antenna may also be used in other applications as well (e.g., radar systems). Moreover, the antenna elements 23 need not be arranged in sub-groups in all embodiments, and the SNOI need not be a friendly signal to perform the above-described nulling operations.

The iterative phase-only nulling operation in accordance with the present invention will now be described further with reference to the graphs of FIGS. 3–8. By way of background, achieving an "ideal" phase-only adaptive weighting in a phased array antenna system would generally require difficult non-linear operations. It is worth noting that the idealized approach (i.e., continuous phase with no amplitude variation) can be expressed in terms of a non-linear eigenvector equation for which no solution is yet known. Even if an ideal analytical solution were known, Applicants theorize that it is highly unlikely that extension to realistic practical configurations, such as quantized phase states with state dependent amplitude variation, would be feasible in the near term.

Consequently, the phased array antenna 22 is based upon the premise of providing a substantially real-time numerical solution for iterative phase-only nulling which, while not necessarily providing ideal convergence, will nonetheless provide reliable convergence to useful solutions in a cost effective manner. Many high-interest phase-only adaptive applications allow important simplifications to be made, which provide favorable initial conditions for iterative phase-only nulling in accordance with the invention. Moreover, by using an array lattice (e.g., an aperiodic lattice array) designed to avoid potentially difficult near-grating conditions, the phased array antenna 22 provides a relatively fast and simple non-linear numerical iteration process which may be implemented using a robust linear algorithm as a core "engine" at the controller 26.

More specifically, a variation of the positive signal feedback (PSF) algorithm first described in U.S. Pat. No. 4,255,791 to Martin, which is assigned to the present Assignee and is hereby incorporated herein in its entirety by reference, and further described in the above-noted U.S. Pat. Nos. 6,188,915 and 6,397,083, is used for adaptively optimizing phase shifter weight states in substantially real time. This approach advantageously allows the relatively large pre-computed beam steering tables used for nulling in certain prior art phased array antennas to be significantly reduced. The present approach may also facilitate closed loop operation, and advantageously non-ideal quantized phase shifters to be accounted for, for example.

The present variation of the PSF algorithm for use with the invention will be referred to as phase constrained PSF (PCPSF) herein for clarity of reference. While PSF solves the well-defined generalized eigenvalue equation $Ax=\lambda Bx$, where A and B are matrices, x is an eigenvector and $\lambda$ is its associated eigenvalue, PCPSF embeds PSF but is empirically based. Linear PSF with full complex weights has been shown to always converge to an ideal or optimum value. While PCPSF may or may not actually converge to such an optimum phase-constrained solution in all circumstances, it will advantageously produce results which are more than adequate for many implementations. For example, this may particularly be true in cases where initial beam pointing direction is known (or approximately known).

As noted briefly above, initial phase/gain weights or settings for a conjugate beam toward the desired SOI 30 is first determined and implemented. The resultant beam will naturally have a suppressed response in sidelobe regions to be nulled, as will be appreciated by those skilled in the art. Thus, the initial weights are "close" to an acceptable final weight. Furthermore, such initial weights, in this case, are also the PSF optimum weights when no interference is present.

Moreover, when the error (which equals the difference in initial and final weights) is small, required phase adjustments (phase delta) may be approximated by the complex delta through the relationship $\sin(\theta)\approx\theta$ (or the inverse, $\theta\approx\arcsin(\theta)$) This suggests that final convergence will be approximately linear, a situation already understood for the above-noted PSF algorithm. Also, PSF inherently calculates a constant norm weight (eigenvector), a property which is useful for phase-only solutions.

It should also be noted that far more degrees of freedom typically exist than necessary for beam and null formation. Thus, any near-optimum solution is likely to be, for practical purposes, essentially as good as the optimum one. In addition, simple, qualitative simulations rapidly converge to a useful solution. That is, no failure to converge to a solution has been observed yet in simulations, which will be discussed further below.

Basic PSF iterates the following equation:

$$dW = -K\left[R_n W - \left(\frac{W^T R_n W}{W^T R_s W}\right) R_s W\right],$$

where W is a complex weighting vector, $R_n$ is the interference plus thermal noise covariance matrix, $R_s$ is the desired signal covariance matrix, and dW is the subsequent weight differential. Superscript "T" means conjugate transpose. At a solution dw=0, this equation becomes $$R_n W = \left(\frac{W^T R_n W}{W^T R_s W}\right) R_s W.$$

From the form of the above equation, one can see that W is an eigenvector of the system, while the real scalar $$\left(\frac{W^T R_n W}{W^T R_s W}\right)$$

is the associated eigenvalue. Notice also that $$\left(\frac{W^T R_n W}{W^T R_s W}\right)$$

is the array output "interference plus noise" to signal ratio (reciprocal of output S/N). This quantity can be used as a performance indicator, with iteration stopped when an acceptable level or threshold of performance is achieved. Alternatively, the change in weights $(dW)^T(dW)$ equal to zero or less than some TBD criteria may be used, as will be appreciated by those skilled in the art.

In narrowband applications, the signal covariance matrix may be approximated by the one-dimensional singular matrix $$R_s = P_s v_s v_s^T,$$

where $v_s$ is the desired signal's steering vector. In a phase-only nulling approach, $v_s$ simply includes exponentials of the phase of arrival at sub-array elements, i.e., $$v_s = \begin{bmatrix} e^{j\phi_1} \\ e^{j\phi_2} \\ \vdots \\ e^{j\phi_N} \end{bmatrix},$$

where $P_s$ is the desired signal's power, as will be appreciated by those skilled in the art. However, this parameter cancels in the PSF formulation, since it appears in both the numerator and denominator of the only term in which it appears, $$\left(\frac{W^T R_n W}{W^T R_s W}\right) R_s W,$$

so $P_s$ may be arbitrarily set to unity.

An important feature of the PSF algorithm is that its adaptation rate is independent of desired signal power (in stark contrast to the least mean squares (LMS) algorithm, for example). The noise covariance matrix $R_n$ is the summation of a diagonal thermal noise matrix and individual undesired signal covariance matrices, as will also be appreciated by those skilled in the art.

For iteration stability, feedback step size is preferably limited. LMS iteration is stable provided that the sum of $R_x$ eigenvalues times the feedback constant is less than unity. PSF permits a larger feedback gain (and associated faster convergence), due to desired signal covariance subtraction. However, this larger allowable gain is condition dependent, so a simple safe normalizing value may be computed from the sum of eigenvalues of $R_n$ (or $R_x$ to be even more conservative). Note that this sum may be obtained from the trace of $R_n$ (or $R_x$) without the need for eigenvalue computation. Typically, one would use less than this critical feedback gain to obtain smoother adaptation transients, perhaps 10% of the critical value. Taking these considerations into account, PSF iteration feedback factor K becomes:

$$K = \frac{k}{\mathrm{Trace}(R_n)},$$

where k typically ranges from about 0.1 to 0.5, for example. Further details regarding the PSF algorithm may be found in the above-noted U.S. Pat. Nos. 4,255,791, 6,188,915 and 6,397,083.

A potentially more challenging situation is present for PCPSF. As discussed below, the PCPSF algorithm is formed by inserting a non-linear weight-mapping step into the iteration. First a complex weight iteration calculation is performed to determine desired phase weights using the relationship $$w_{i+1} = W_i + dW_i.$$

The desired weights are then mapped into available (quantized phase only) values through the non-linear function "Phasor", specifically:

$$W_{i+1} = \mathrm{Phasor}(w_i) = \mathrm{Phasor}(W_i + dW_i).$$

The function phasor extracts, restricts and adjusts phase portions of the iterated complex weights. If continuously variable ideal phase shifters are to be simulated, MATLAB function "Angle(w)" performs this mapping required by phasor, for example. However, in most practical applications, available phase states are quantized and have a small amplitude variation with state, as will be appreciated by those skilled in the art.

For purposes of the present discussion, it will be assumed that all phase shifters are imperfect but identical. In this moderately restrictive case, phasor operation includes the following process steps. For each individual complex scalar weight in the iterated vector w, the difference between the desired complex value and each of the available phase shifter values is computed, including any associated amplitude variation. Next, the achievable phase weight state with the smallest difference from ideal (i.e., the value nearest or closest to the iterated complex weight value) is selected. The ideal iterated weight is then replaced or mapped to the nearest available phase setting.

When only a few achievable phase settings are available (e.g., 3-bit phase shifters are used) and little amplitude variation with state is present, then an alternate process (which may be somewhat more inexact but also faster) may be used. This approach assumes that the achievable phase shifter setting closest in phase to the iterated weight will also be the state with minimum difference between computed weight and achievable state. This process is as follows. Only the phase portions of the iterated complex weights is retained. In MATLAB, this can be implemented by the command "angle($W_{i+1}$)". The achievable device weight STATE having a phase closest to the desired value is then selected. Further, the iterated weight with the complex value (quantized with amplitude dependence) associated with the device state identified in the previous step is replaced.

Importantly, this second process facilitates simulation with continuously variable ideal phase weights, since only a simple use of the MATLAB angle function is required. Given a TBD large number of achievable phase states and TBD appreciable amplitude variation with state, it is to be expected that phase comparison alone will occasionally result in the selection of a weight state that is not the closest to the specified value.

Examples of the two methods described above are now provided. In each example, an imperfect hypothetical 3-bit phase shifter is assumed, as is an exemplary PSF iterated weight vector, w. Let $$w_{i+1} = \begin{bmatrix} (0.7 + j0.4) \\ (-0.3 + j1.2) \\ \vdots \end{bmatrix} = \begin{bmatrix} 0.806e^{j29.75°} \\ 1.237e^{j104.04°} \\ \vdots \end{bmatrix}.$$

With non-ideal but repeatable 3-bit devices, the first three of the eight realizable values might actually be $$\text{States} = \begin{bmatrix} 1.10e^{-j4.7°} \\ 0.82e^{j42.6°} \\ 0.95e^{j93.7°} \\ \text{etc.} \end{bmatrix}.$$

Computing the complex vector difference between each desired weight and available weights shows that phase shifter state (1) most nearly equals the desired weight (1) value and that phase shifter state (3) most nearly matches the desired value for weight (2). Consequently, the result of the phasor function in this example is $$W_{i+1} = \mathrm{Phasor}(W_i + dW_i) = \begin{bmatrix} 1.10e^{-j4.7°} \\ 0.95e^{j93.7°} \\ \vdots \end{bmatrix}.$$

The second approach outlined above would be as follows. First, an angle operation yields a vector with phase shift only, namely $$P_{i+1} = \text{Angle}(w_{i+1}) = \begin{bmatrix} e^{j29.75°} \\ e^{j104.04°} \\ \vdots \end{bmatrix}.$$

Again, with the assumed non-ideal but repeatable 3-bit phase shifters, $$\text{States} = \begin{bmatrix} 1.10e^{-j4.7°} \\ 0.82e^{j42.6°} \\ 0.95e^{j93.7°} \\ \text{etc.} \end{bmatrix}.$$

Selecting states based on minimum phase differences between desired weights and available settings results in the same mapped weight update vector as in the first example, where the result is:

$$W_{i+1} = \begin{bmatrix} 1.10e^{-j4.7°} \\ 0.95e^{j93.7°} \\ \vdots \end{bmatrix}.$$

It is worth observing that even if a closed form solution of an ideal phase-only optimization was available, it would not apply under the conditions of quantization and amplitude imperfection treated by the above numerical solution process.

PCPSF may require substantial reduction in iteration gain relative to PSF. To approach the implicit small angle approximations mentioned above, the N-dimensional correction vector dW is preferably restricted to a step limit to span less than one radian along a great circle in weight space. Since dW is always orthogonal to W, this means that $$\sqrt{\frac{(dW)^T(dW)}{W^TW}}$$

should preferably be kept to about 0.1 to satisfy the small angle approximation thought necessary for stability in convergence. While the N-dimensional weight vector angle change is only about 5.7° with k=0.1, the resultant vector might have several low-amplitude weight components that would change substantially, and possibly detrimentally, in phasor mapping. For this reason, an even smaller value for k of about 0.05 may be used as a starting point.

Figure 3:
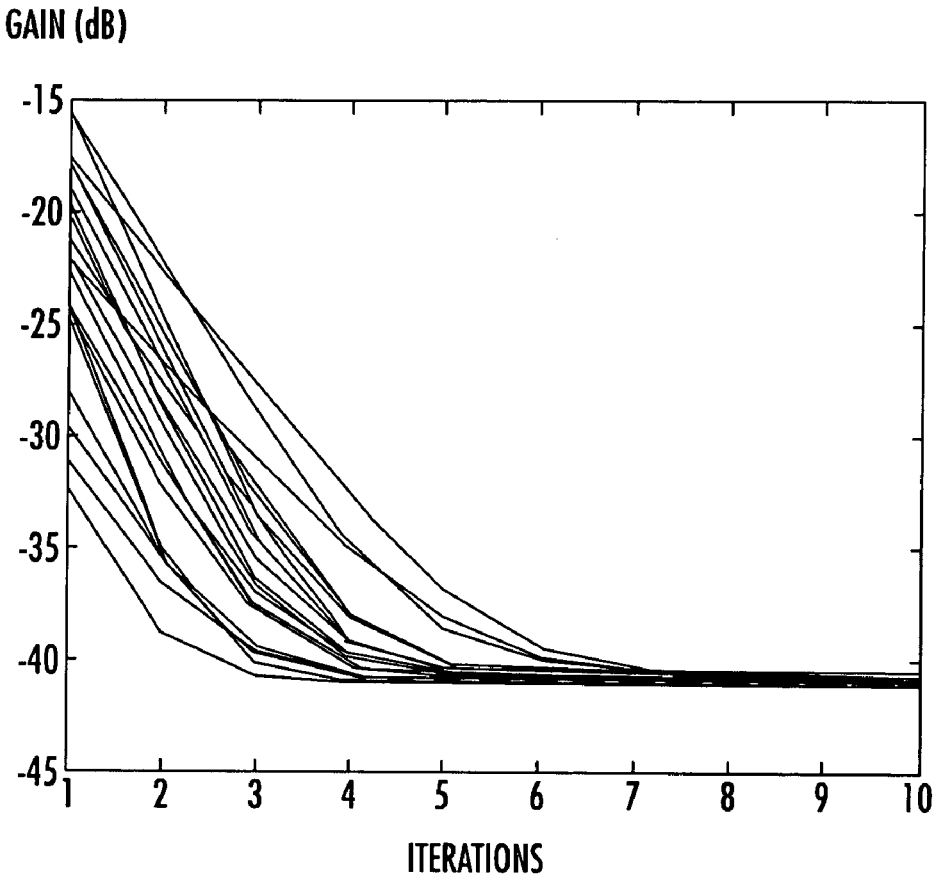
FIGS. 3–5 are graphs illustrating null convergence results for a simulated phased array antenna in accordance with the present invention.
Figure 4:
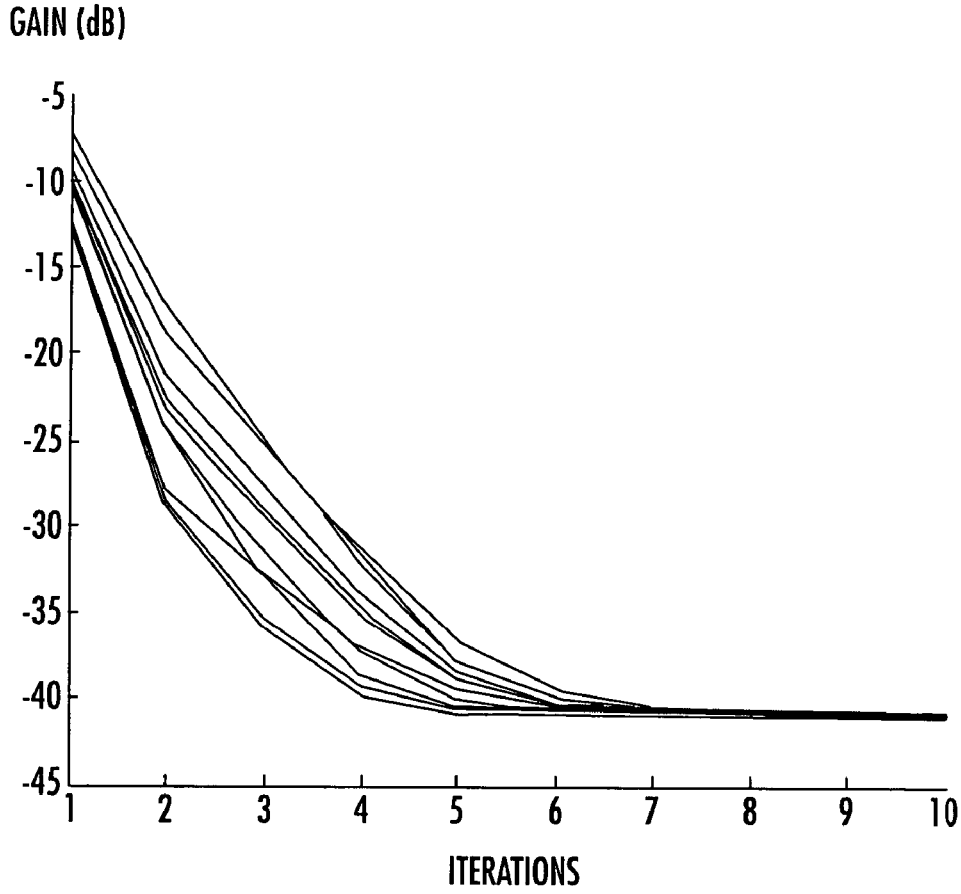

Initial qualitative MATLAB simulation has shown convergence to useful solutions in five to ten iterations for a 64-element array, one SOI and one SNOI, given an initial beam on the SOI, as seen in FIGS. 3 and 4. More particularly, a 64-element sub-array was simulated with the target null in the direction of the SNOI set to a 40 dB threshold. Such a relatively small number of iterations to convergence would advantageously allow real time control to be used in many low dynamics applications, for example. Moreover, because the basic PSF algorithm is used as a core "engine" in the solution process, numerous input parameter variations and options exist, as will be appreciated by those skilled in the art.

Figure 6:
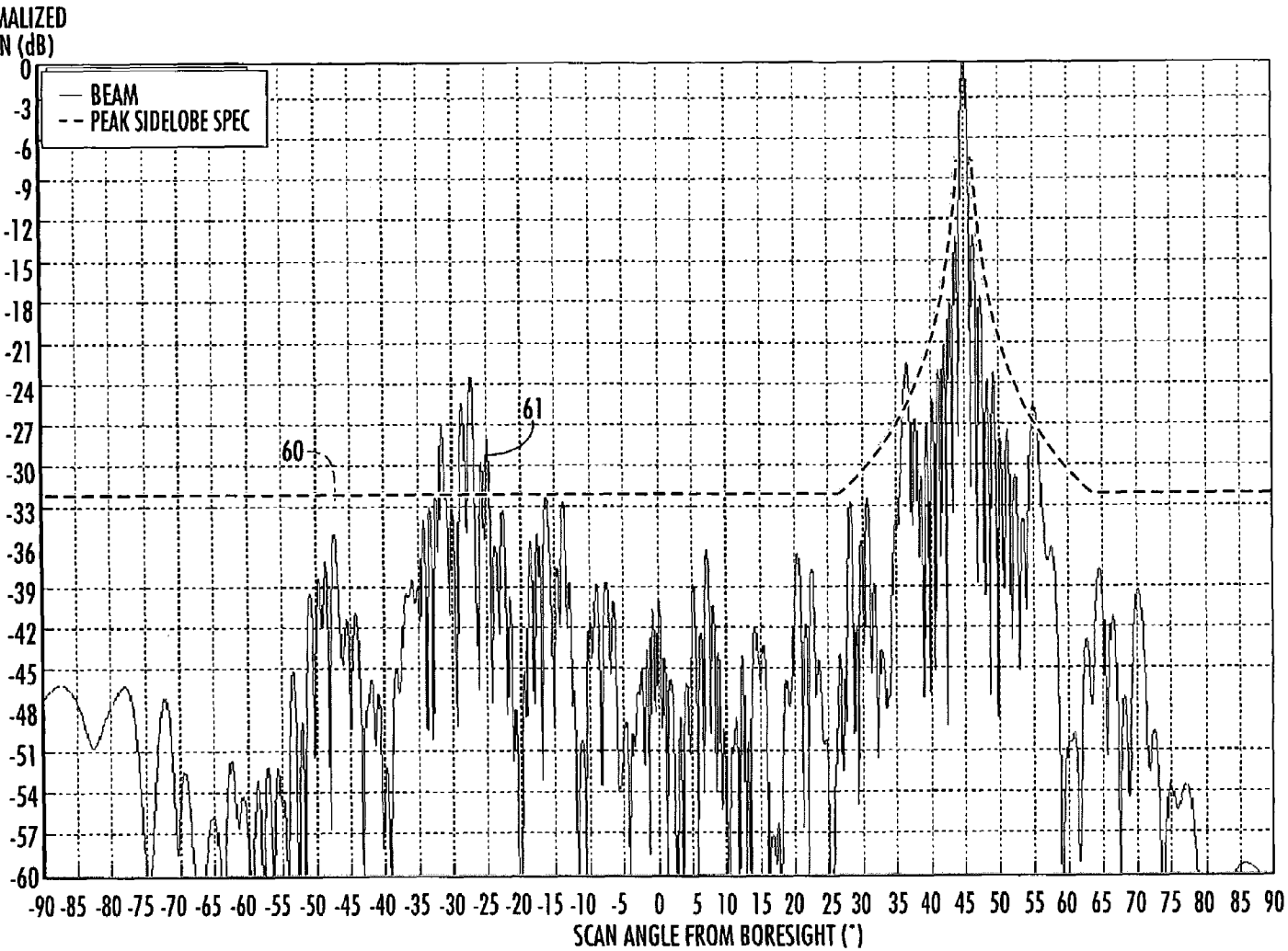
FIGS. 6–8 are graphs illustrating a signal reception pattern of a signal of interest before and after iterative phase-only nulling for a simulated phased array antenna in accordance with the present invention.
Figure 7:
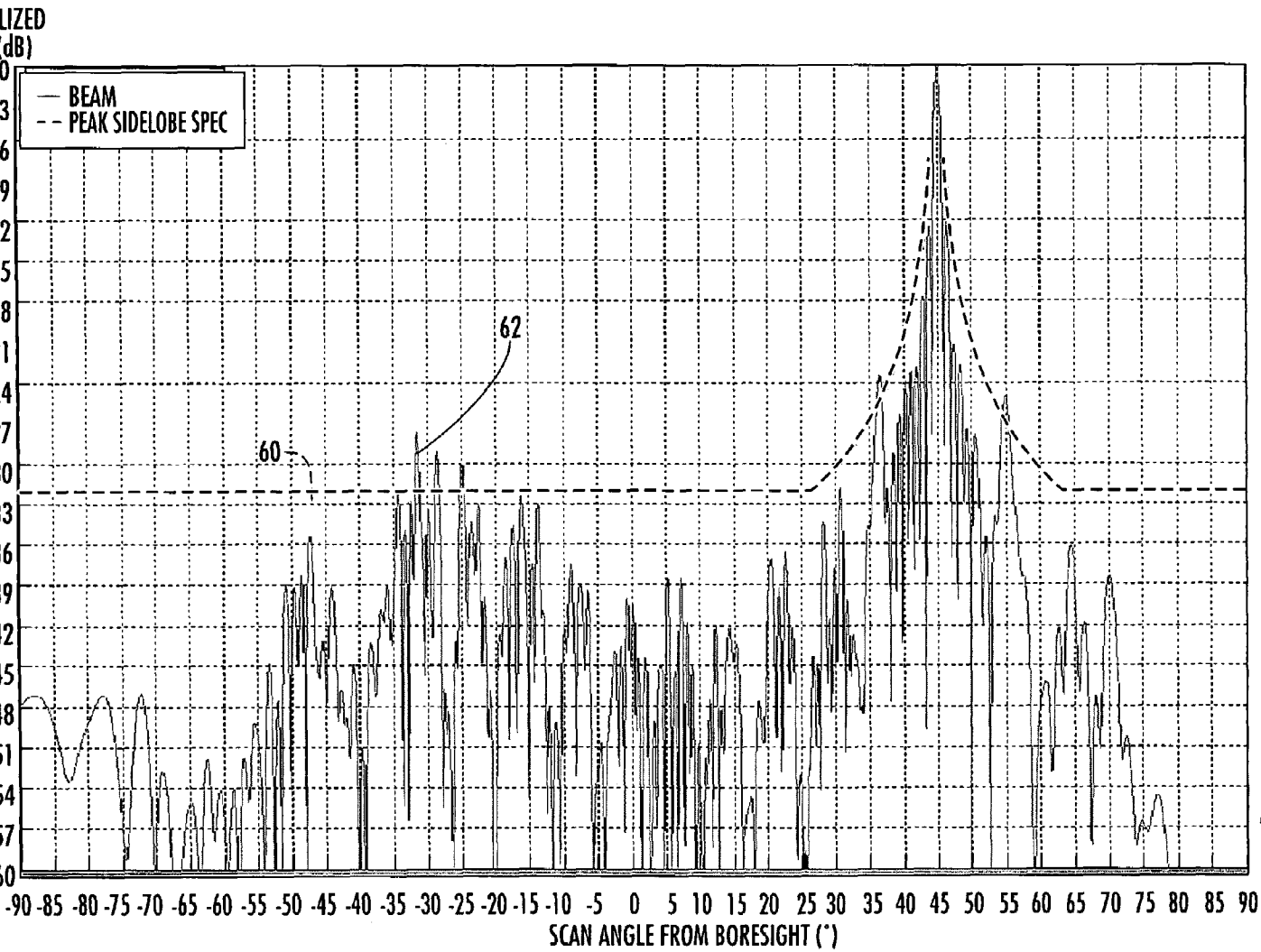
Figure 8:
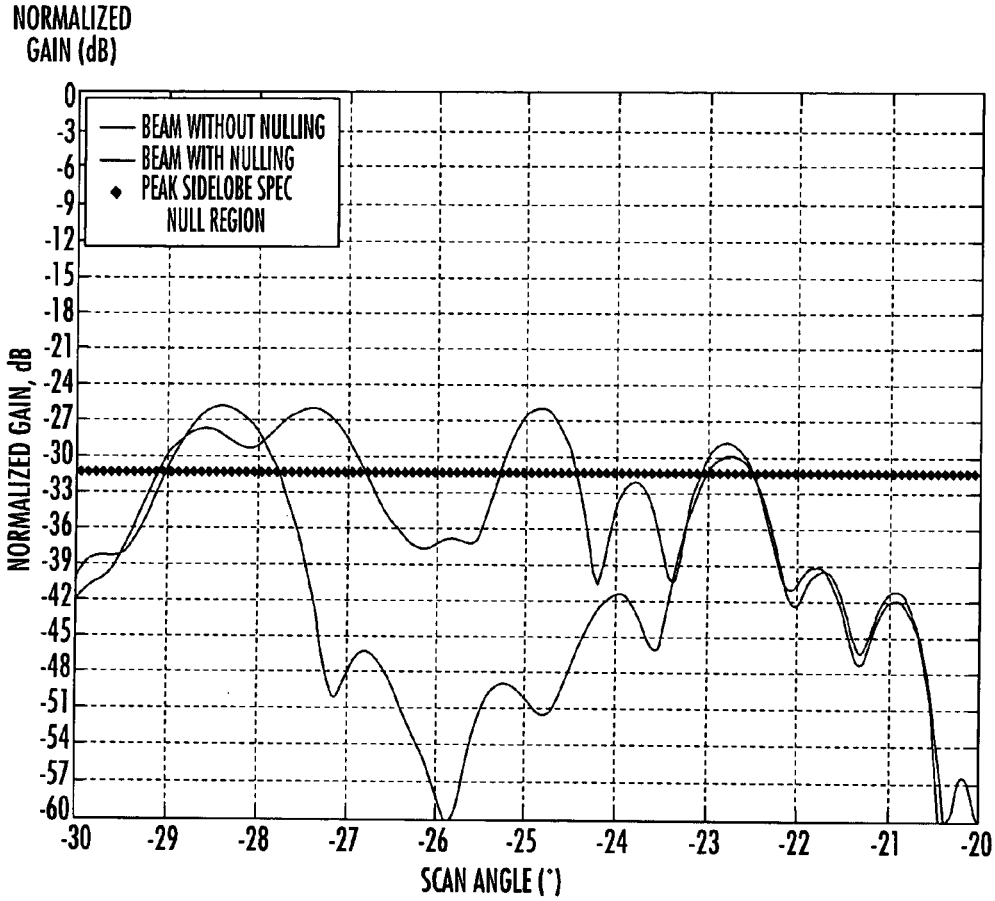

Signal reception patterns for an SOI both before and after nulling for the above-noted 64-element array are respectively shown in FIGS. 6 and 7. In these figures, a peak sidelobe specification for the signal is represented by the dotted line 60, and the SOI before and after phase-only nulling are indicated by reference numerals 61, 62, respectively. For this simulation, the beam was steered to 0.0° azimuth with a 45° scan angle at 14.625 GHz with a main beam gain of 41.41 dB. The desired null region was between scan angles −24.966° and −25.067°. The time delay quantization was 0.242 ns, with a five-bit phase quantization and up to a two-bit change for nulling. The amplitude quantization was 0.5 dB with a 6.0 dB maximum allowed for nulling. The nulling loss was 0.225 dB, and there was a −49.7 dB gain with respect to the main beam in the null region. As may be seen, a significant null is produced in the null region using the PCPSF approach. A close-up view of the null region including the SOI both before and after nulling is provided in FIG. 8 for clarity of illustration.

Figure 5:
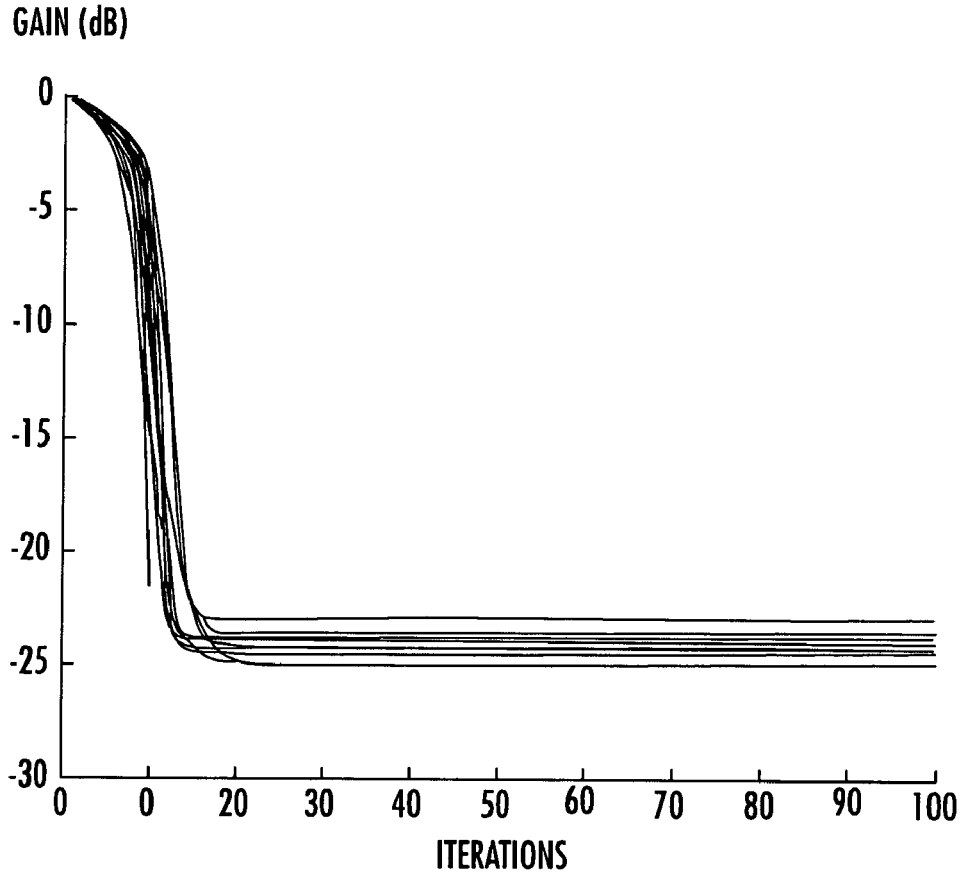

Moreover, as illustrated in FIG. 5, the PCPSF approach advantageously provides convergence even with correlation between the desired and interfering steering vectors in about ten to twenty iterations for the 64-element aperiodic array. For this simulation, runs for multiple initial random phase conditions were performed with the interference steering vector being 90% correlated with that of the SOI. The signal and interference to thermal noise ratios were set at 40 dB.

An application where a priori knowledge of both SOI and SNOI directions is available as well as calibration data (e.g., array element, lattice, and phase shifter properties) will now be considered. Suppose that the array is on a platform moving with respect to the SOI and SNOI signals, so that continual adaptation is necessary. With each platform position update, the previous PCPSF phase settings are iterated and phase shifter values applied open-loop to the physical array. Given that only modest nulling of the SNOI is required (mostly suppression of high sidelobes), lack of high precision SNOI direction information would not be an important issue. A number of spatially close hypothetical SNOI sources as well as SNOI sources separated in frequency that collectively cover both the extent of SNOI angle of arrival (AOA) uncertainty and SNOI bandwidth in the formation of $R_n$ can help to mitigate the effect of lack of precise SNOI knowledge, as will be appreciated by those skilled in the art.

Additionally, a closed-loop implementation of the process will be the same as described above except that it will be without high precision calibration data, without high precision SOI and SNOI pointing, and with a hardware performance estimation interface to actual array output. Feedback data is provided directly to the core PSF algorithm, which then generates appropriate adaptive inputs to the non-linear phasor mapping function. Such a closed-loop adaptive system may potentially be used to correct for a number of array and weighting and combining network imperfections, all within the quantized phase shifter constraint.

In many large phased array antennas, the antenna elements are architecturally partitioned into sub-arrays that are subsequently combined into a single array output. If the sub-arrays are nominally identical, then additional cost and performance-effective sub-optimum solutions based on sub-array level adaptive optimization may be used, as will be appreciated by those skilled in the art.

When many phase shifter degrees of freedom are available but only a few independent nulls are needed, sub-optimum solutions may in some circumstances be almost indistinguishable from the optimum one. Consider a 4096-element array partitioned into 64 sub-arrays of 64 elements each. If each sub-array is adapted to have adequate beams and nulls, and one sub-array solution "fits all" due to the "nominally identical" assumption, then the pattern multiplication principle applies, where a sub-array becomes an "element" in the larger array.

One particular advantage of such an approach is the significantly reduced phase shifter setting mathematics, since a much smaller dimension problem can be solved. Two major options exist for combining such "identical" sub-arrays. First, simple phase adjustment of each sub-array's output to account for sub-array phase center displacements may be used. Second, secondary adaptive combining of already adapted sub-arrays may also be used.

In either case, required phase shift for combining sub-arrays can be "rippled" into the sub-array phase shifters, which reduces the need for any phase shifters or complex weights at the sub-array combining level. While this assertion is ideally true, practical phase shifters with quantization, nominal departure from ideal phase state, and state dependent amplitude variation prevent such an adjustment from being perfect. In fact, such imperfection could provide justification for an optional second level of adaptation. Again, in either instance, the PCPSF approach may be used to calculate appropriate phase shifter adjustments.

A second layer of adaptive combining provides a more effective distribution of sub-array phase center phase shifts into the sub-arrays. Unfortunately, sub-array patterns will change when a common additive phase is applied because of phase shifter state quantization and non-ideal state values. Given N-bit phase shifters, $2^N$ uniquely different sub-array patterns can result. Further, with incremental phase due to addition of sub-array phase center terms, the nearest available phase state for a given element in a sub-array might well be different from that computed for the representative sub-array. Adaptation at the sub-array level could mitigate these effects. In demanding applications, introducing sub-array-level phase adjustments might necessitate a re-evaluation or re-adaptation of individual sub-array patterns with the new discrete phase shifter settings. Another alternative is additional phase shifter hardware for sub-array combining, despite that fact that such devices would be mathematically redundant.

Factoring a large array into identical sub-arrays and invoking the pattern multiplication principle imparts a second potential advantage. One expects main beam contributions to add coherently, since the main beam is a maximum with well-controlled amplitude and phase variation. On the other hand, sub-array sidelobes and especially sub-array nulls are likely to vary appreciably among the actual physical sub-arrays due to manufacturing tolerances and calibration variation. Therefore, main beam gain may be expected to increase directly with the number of sub-arrays combined, while null regions dominated by residual errors are expected to add incoherently, proportional to the square root of sub-arrays combined and no worse than the coherent combination expected for the main beam. Given the difficulty of predicting sidelobe response of a composite large array (e.g., 4096 elements), it is possible that the "identical sub-array" combining method would actually yield better results, practically speaking, than with direct control of the large array.

Figure 9:
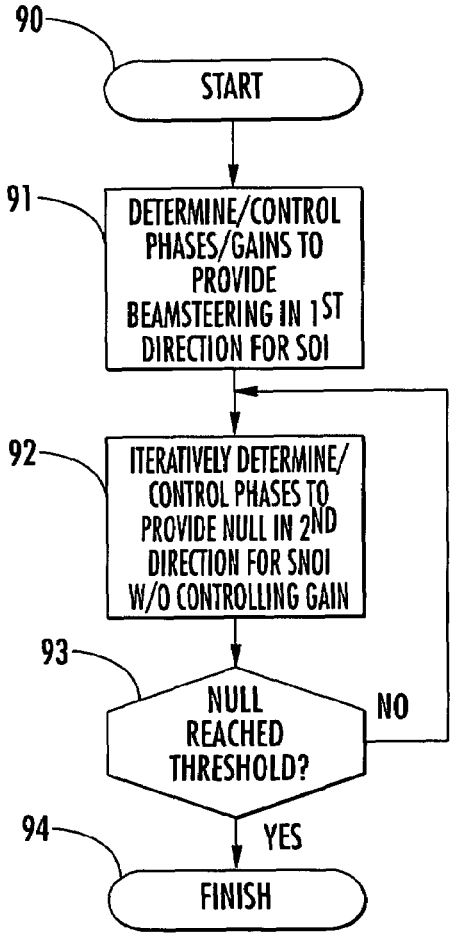
FIGS. 9–11 are flow charts illustrating method aspects in accordance with the present invention.

A first method aspect in accordance with the present invention for controlling a phased array antenna, such as the antenna 22 described above, is now described with reference to FIG. 9. The method begins (Block 90) with determining and controlling both phases and gains of the phase shifters 24 and gain elements 25, respectively, to provide beamsteering in a first direction for an SOI, at Block 91, as previously described above. Phases of the phase shifters 24 are then iteratively determined and controlled to provide a null in a second direction for an SNOI, and without determining or controlling gains of the gain elements 25, at Block 92. This is done until the null reaches a threshold, at Block 93, as also described above, thus completing the illustrated method (Block 94).

Figure 10:
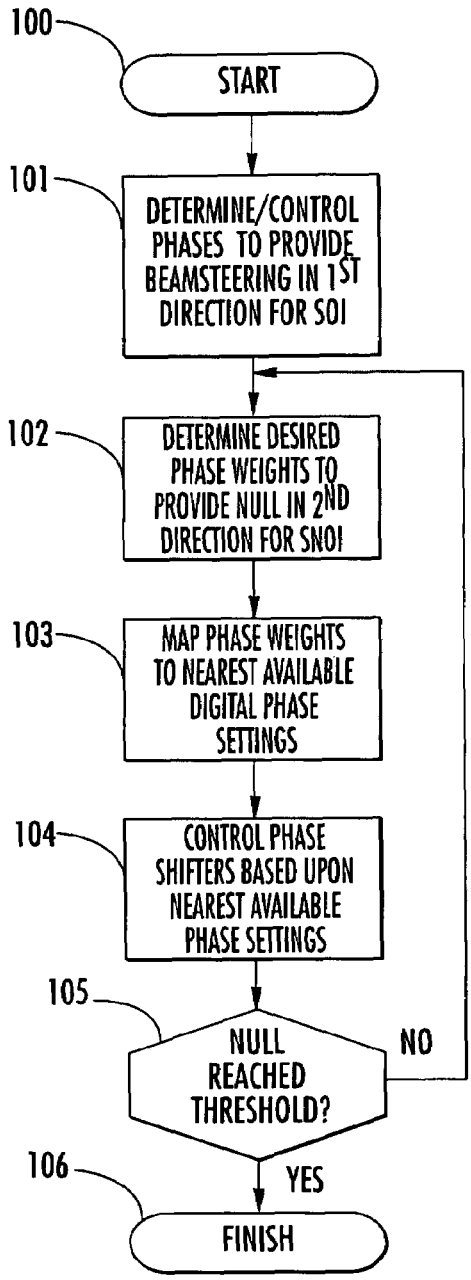

Another method aspect of the present invention for controlling a phased array antenna, such as the antenna 22 described above, is now described with reference to FIG. 10. Beginning at Block 100, phases of the phase shifters 24 (and, optionally, gains of the gain elements 25) are determined and controlled to provide beamsteering in a first direction for an SOI, at Block 101. The method further illustratively includes iteratively determining desired phase weights to provide a null in a second direction for an SNOI, at Block 102, mapping the desired phase weights to nearest available digital phase settings of the phase shifters 24 (Block 103), and controlling phases of the phase shifters based thereon, at Block 104, as discussed above. Again, the steps illustrated at Blocks 102–105 are iteratively performed until the null reaches a threshold, at Block 105, thus concluding the illustrated method (Block 106).

Figure 11:
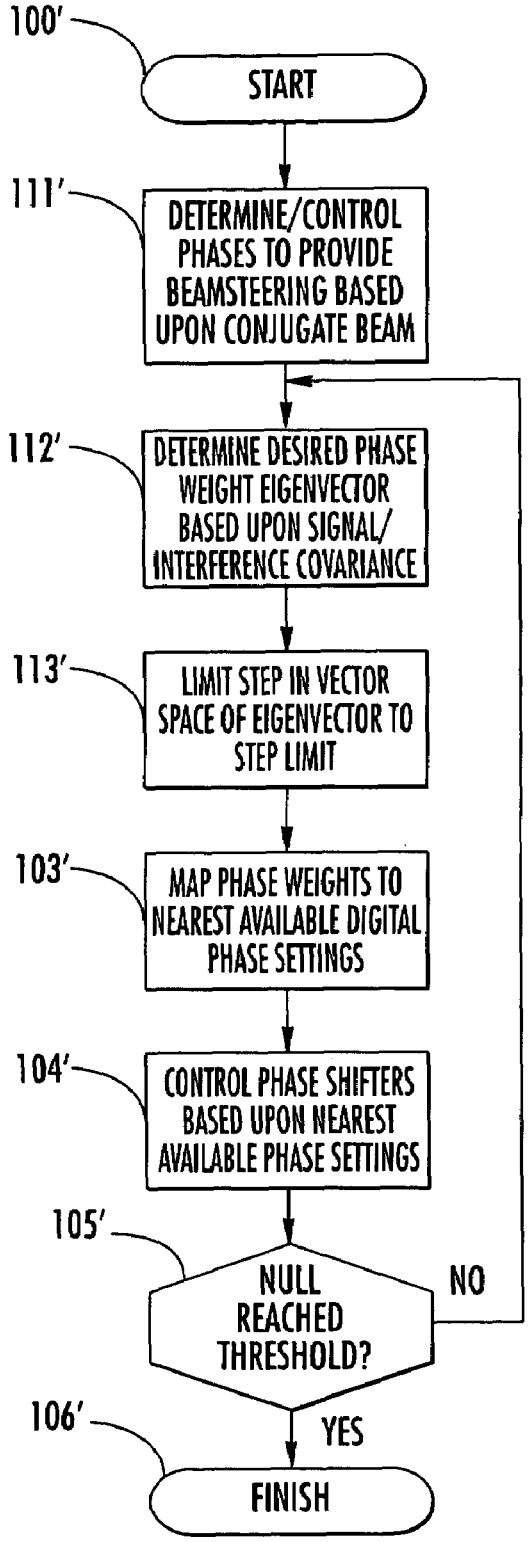

Referring more particularly to FIG. 11, additional aspects of the method are now described. More particularly, the determination and control of the phase and/or gain setting for beamsteering in the first direction may be performed based upon a conjugate beam in the first direction at step 111', as discussed previously above. Moreover, the desired phase weights may take the form of an eigenvector determined based upon signal covariance and interference covariance of the antenna elements 23, at Block 112', as also discussed above. Further, the step in the vector space of the eigenvector may also be limited to a step limit, as noted above, at Block 113'.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A phased array antenna comprising:

a plurality of antenna elements;

at least one respective phase shifter connected to each antenna element, each phase shifter having a plurality of digitally selectable phase settings;

at least one respective gain element connected to each antenna element; and at least one controller for determining and controlling both phases and gains of said phase shifters and gain elements, respectively, to provide beamsteering in a first direction for a signal of interest, and iteratively determining and controlling phases of said phase shifters to provide a null in a second direction for a signal not of interest and without determining or controlling gains of said gain elements, said at least one controller determining the phases to provide the null in the second direction by determining desired phase weights and mapping the desired phase weights to nearest available digital phase settings of said phase shifters.

2. The phased array antenna of claim 1 wherein the desired phase weights comprise an eigenvector.

3. The phased array antenna of claim 2 wherein said at least one controller limits a step in vector space of the eigenvector to a step limit between successive iterations.

4. The phased array antenna of claim 1 wherein said at least one controller determines the desired phase weights based upon a signal covariance and an interference covariance of said antenna elements.

5. The phased array antenna of claim 1 wherein said at least one controller iteratively determines and controls the phases until the null reaches a threshold.

6. The phased array antenna of claim 1 wherein said at least one controller determines the phases and gains of said phase shifters and gain elements to provide beamsteering in the first direction based upon a conjugate beam in the first direction.

7. The phased array antenna of claim 1 wherein said antenna elements are arranged in sub-groups to provide multi-beam operation.

8. The phased array antenna of claim 1 wherein said antenna elements are arranged in an aperiodic array.

9. A phased array antenna comprising:

a plurality of antenna elements;

at least one respective phase shifter connected to each antenna element, each phase shifter having a plurality of digitally selectable phase settings; and at least one controller for determining and controlling phases of said phase shifters to provide beamsteering in a first direction for a signal of interest, and iteratively determining desired phase weights to provide a null in a second direction for a signal not of interest, mapping the desired phase weights to nearest available digital phase settings of said phase shifters, and controlling phases of said phase shifters based thereon.

10. The phased array antenna of claim 9 wherein the desired phase weights comprise an eigenvector.

11. The phased array antenna of claim 10 wherein said at least one controller limits a step in vector space of the eigenvector to a step limit between successive iterations.

12. The phased array antenna of claim 9 wherein said at least one controller determines the desired phase weights based upon a signal covariance and an interference covariance of said antenna elements.

13. The phased array antenna of claim 9 wherein said at least one controller iteratively determines the desired phase weights, maps the desired phase weights, and controls the phases until the null reaches a threshold.

14. The phased array antenna of claim 9 wherein said at least one controller determines the phases of said phase shifters to provide beamsteering in the first direction based upon a conjugate beam in the first direction.

15. The phased array antenna of claim 9 wherein said antenna elements are arranged in sub-groups to provide multi-beam operation.

16. The phased array antenna of claim 9 wherein said antenna elements are arranged in an aperiodic array.

17. A communications system comprising:

a receiver; and a phased array antenna connected to said receiver and comprising a plurality of antenna elements, at least one respective phase shifter connected to each antenna element, each phase shifter having a plurality of digitally selectable phase settings, at least one respective gain element connected to each antenna element, and at least one controller for determining and controlling both phases and gains of said phase shifters and gain elements, respectively, to provide beamsteering in a first direction for a signal of interest, and iteratively determining and controlling phases of said phase shifters to provide a null in a second direction for a signal not of interest and without determining or controlling gains of said gain elements, said at least one controller determining the phases to provide the null in the second direction by determining desired phase weights and mapping the desired phase weights to nearest available digital phase settings of said phase shifters.

18. The communications system of claim 17 wherein the desired phase weights comprise an eigenvector.

19. The communications system of claim 18 wherein said at least one controller limits a step in vector space of the eigenvector to a step limit between successive iterations.

20. The communications system of claim 17 wherein said at least one controller determines the desired phase weights based upon a signal covariance and an interference covariance of said antenna elements.

21. The communications system of claim 17 wherein said at least one controller determines the phases and gains of said phase shifters and gain elements to provide beamsteering in the if first direction based upon a conjugate beam in the first direction.

22. The communications system of claim 17 wherein said antenna elements are arranged in sub-groups to provide multi-beam operation.

23. The communications system of claim 17 wherein said at least one controller iteratively determines and controls the phases until the null reaches a threshold.

24. A communications system comprising:

a receiver; and a phased array antenna connected to said receiver and comprising a plurality of antenna elements, at least one respective phase shifter connected to each antenna element, each phase shifter having a plurality of digitally selectable phase settings, and at least one controller for determining and controlling phases of said phase shifters to provide beamsteering in a first direction for a signal of interest, and iteratively determining desired phase weights to provide a null in a second direction for a signal not of interest, mapping the desired phase weights to nearest available digital phase settings of said phase shifters, and controlling phases of said phase shifters based thereon.

25. The communications system of claim 24 wherein the desired phase weights comprise an eigenvector.

26. The communications system of claim 25 wherein said at least one controller limits a step in vector space of the eigenvector to a step limit between successive iterations.

27. The communications system of claim 24 wherein said at least one controller determines the desired phase weights based upon a signal covariance and an interference covariance of said antenna elements.

28. The communications system of claim 24 wherein said at least one controller determines the phases of said phase shifters to provide beamsteering in the first direction based upon a conjugate beam in the first direction.

29. The communications system of claim 24 wherein said antenna elements are arranged in sub-groups to provide multi-beam operation.

30. The communications system of claim 24 wherein said at least one controller iteratively determines the desired phase weights, maps the desired phase weights, and controls the phases until the null reaches a threshold.

31. A method for controlling a phased array antenna comprising a plurality of antenna elements, at least one respective phase shifter connected to each antenna element where each phase shifter has a plurality of digitally selectable phase settings, and at least one respective gain element connected to each antenna element, the method comprising:

determining and controlling both phases and gains of the phase shifters and gain elements, respectively, to provide beamsteering in a first direction for a signal of interest; and iteratively determining and controlling phases of the phase shifters to provide a null in a second direction for a signal not of interest and without determining or controlling gains of the gain elements by iteratively determining desired phase weights and mapping the desired phase weights to nearest available digital phase settings of the phase shifters.

32. The method of claim 31 wherein the desired phase weights comprise an eigenvector.

33. The method of claim 32 iteratively determining the desired phase weights comprises limiting a step in vector space of the eigenvector to a step limit between successive iterations.

34. The method of claim 31 wherein iteratively determining the desired phase weights comprises iteratively determining the desired phase weights based upon a signal covariance and an interference covariance of the antenna elements.

35. The method of claim 31 wherein determining the phases and gains of the phase shifters and gain elements to provide beamsteering in the first direction comprises determining the phases and gains based upon a conjugate beam in the first direction.

36. A method for controlling a phased array antenna comprising a plurality of antenna elements and at least one respective phase shifter connected to each antenna element, each phase shifter having a plurality of digitally selectable phase settings, the method comprising:

determining and controlling phases of the phase shifters to provide beamsteering in a first direction for a signal of interest; and iteratively determining desired phase weights to provide a null in a second direction for a signal not of interest, mapping the desired phase weights to nearest available digital phase settings of the phase shifters, and controlling phases of the phase shifters based thereon.

37. The method of claim 36 wherein the desired phase weights comprise an eigenvector.

38. The method of claim 37 wherein iteratively determining the desired phase weights comprises limiting a step in vector space of the eigenvector to a step limit between successive iterations.

39. The method of claim 36 wherein iteratively determining the desired phase weights comprises iteratively determining the desired phase weights based upon a signal covariance and an interference covariance of the antenna elements.

40. The method of claim 36 wherein determining the phases of the phase shifters to provide beamsteering in the first direction comprises determining the phases based upon a conjugate beam in the first direction.

* * * * *

UNITED STATES PATENT AND TRADEMARK OFFICE

CERTIFICATE OF CORRECTION

PATENT NO. : 7,068,219 B2
APPLICATION NO. : 10/864922
DATED : June 27, 2006
INVENTOR(S) : Gayle Patrick Martin, Harry Richard Phelan and Mark Larry Goldstein It is certified that error appears in the above-identified patent and that said Letters Patent is hereby corrected as shown below:

| | |
|---|---|
| | Delete: "in the if first" |
| Column 14, Line 34 | Insert: -- in the first -- |

Signed and Sealed this

Twelfth Day of June, 2007

JON W. DUDAS
*Director of the United States Patent and Trademark Office*